US007271717B1

(12) United States Patent
Amos

(10) Patent No.: US 7,271,717 B1
(45) Date of Patent: Sep. 18, 2007

(54) TWO-WAY EMERGENCY ALERT SYSTEM

(76) Inventor: Vergie M. Amos, 2144 400 Rd., Dundee, MS (US) 38626

( * ) Notice: Subject to any disclaimer, the term of this patent is extended or adjusted under 35 U.S.C. 154(b) by 193 days.

(21) Appl. No.: 11/113,719

(22) Filed: Apr. 26, 2005

(51) Int. Cl.
*G08B 1/08* (2006.01)

(52) U.S. Cl. ..... 340/539.15; 340/539.1; 340/522; 340/573.1; 340/573.4

(58) Field of Classification Search ..... 340/539.15, 340/539.13, 539.1, 522, 573.1, 568.1, 573.4; 600/300; 128/904
See application file for complete search history.

(56) References Cited

U.S. PATENT DOCUMENTS 4,798,082 A * 1/1989 Fujikawa et al. ..... 73/117.3
5,661,460 A * 8/1997 Sallen et al. ..... 340/573.4
5,729,203 A 3/1998 Oka et al.
5,923,253 A 7/1999 Anastasiou
6,075,442 A * 6/2000 Welch ..... 340/573.1
6,078,260 A * 6/2000 Desch ..... 340/573.1
6,091,329 A * 7/2000 Newman ..... 340/539.15
6,094,140 A 7/2000 Parente
6,185,410 B1 * 2/2001 Greene ..... 455/100
6,326,891 B1 * 12/2001 Lin ..... 340/573.4
6,593,851 B1 * 7/2003 Bornstein ..... 340/539.15
6,731,214 B2 * 5/2004 Kuo ..... 340/573.1

* cited by examiner

*Primary Examiner*—Anh V. La
(74) *Attorney, Agent, or Firm*—Mark A. Crossley; Crossley Patent Law

(57) ABSTRACT

A two-way emergency alert system comprising two devices in communication for a minimum of 1500 feet apart, each device featuring a sequential button for on, audio alarm, vibratory alarm, and off, each device further comprising a low battery indicator, alarm activation button, and a reset, each device further comprising a distance meter for gauging distances between the two devices, and a GPS instrument for locating one device with respect to the other. The devices are offered both in necklace form and bracelet form and each includes an internal antenna connected to a transmitter and a receiver.

12 Claims, 3 Drawing Sheets

TWO-WAY EMERGENCY ALERT SYSTEM

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Pagers of various varieties have been marketed for years. Pagers with alert transmitting capabilities have also been available. Various communication problems, though, are still unsolved. Problems exist in the public with instant communication needs. Alerting someone of a distress situation has been limited, in typical pursuits, to one-way pagers that page a central alarm location or the like. Two-way communication devices exist but do not include all functions needed to establish assurances wanted by many people. The present invention solves these problems.

FIELD OF THE INVENTION

The invention relates to communication devices and more specifically to a two-way emergency alert system worn be two persons.

SUMMARY OF THE INVENTION

The general purpose of the two-way emergency alert system, described subsequently in greater detail, is to provide a two-way emergency alert system which has many novel features that result in an improved two-way emergency alert system which is not anticipated, rendered obvious, suggested, or even implied by prior art, either alone or in combination thereof.

To accomplish this, the two-way emergency alert system comprises a pair of separable devices for use by two persons. Each device comprises a microprocessor assembly of communicating components. The components are comprised of a microprocessor, a transmitter, a receiver, an antenna, an audio alarm, and a vibrator. A housing contains the microprocessor. A battery power source is contained within the housing for the microprocessor assembly. Control buttons are tactilely contained within the housing. The control buttons communicate with the microprocessor. The control buttons partially comprise a 4-way sequential button. The sequential button is sequentially depressed to control, in order, on, audio alarm, vibration alarm, and off. An alarm activation button is also disposed within the housing. The housing further contains a reset button. Additionally, the housing comprises a low battery indicator light. Further examples of the devices contain GPS (Global Positioning Satellite) instruments with display. Another example of the invention features housings containing distance meters with display, whereby the distance between the two persons is indicated. Distance is indicated in feet separating the two users. Further examples display distances in meters. Each person wearing the device has the capability of signaling the other device wearer. Each device wearer sets the controls as desired to either receive audio alarm or vibratory alarm from the other person. Each person is capable of pushing the alarm button for sending an alarm signal. Each person manually activates the device to be in readiness for the functions contained in the device. Each device is turned on or off at will. The sequential button allows a user to sequentially push the button to select first on. The next push of the button selects audio alarm. The next push of the button selects vibratory alarm. The next push of the button selects off. Each device reset button enables a person to reset the functions of the device. Electronic technology of the microprocessor and the communicating electronics provide for a minimum range of 1500 feet in each device communicating with the other. As example of use, if the alarm button is pushed by a child, the caregiver is notified by either their own audio alarm or by their own vibratory alarm. The child signaling alarm has the same choice in alarm signals, so that the child knows that the alarm button functioned. A caregiver in such a situation would most likely set the child's device to audio, to further assist the caregiver in locating the child. Depending upon the example provided, the caregiver views the distance meter to assist in constantly approaching the child until the child is located. In using the example of the invention provided with the GPS instrument, the caregiver uses the GPS instrument to locate the child. Upon location of the child, the caregiver uses the reset buttons to turn off both devices.

The most complete examples of the device are water resistant. The devices are optionally offered in either a band form or a pendant form. The band form examples incorporate the device within a band that is worn as a bracelet or as necklace. The pendant form has an orifice for the receipt of a necklace, bracelet, or the like. Additionally, the pendant form is offered with a necklace or bracelet included. The back side of each housing contains battery access. A slotted disc provides for a screwdriver to turn the access to install or change a battery within. Batteries power each device.

Thus has been broadly outlined the more important features of the two-way emergency alert system so that the detailed description thereof that follows may be better understood and in order that the present contribution to the art may be better appreciated.

Numerous objects, features and advantages of the two-way emergency alert system will be readily apparent to those of ordinary skill in the art upon reading the following detailed description of presently preferred, but nonetheless illustrative, examples of the two-way emergency alert system when taken in conjunction with the accompanying drawings. In this respect, before explaining the current examples of the two-way emergency alert system in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the two-way emergency alert system. It is therefore important that the claims be regarded as including such equivalent constructions insofar as they do not depart from the spirit and scope of the present invention.

Objects of the two-way emergency alert system, along with various novel features that characterize the invention are particularly pointed out in the claims forming a part of this disclosure. For better understanding of the two-way emergency alert system, its operating advantages and specific objects attained by its uses, refer to the accompanying drawings and description.

DETAILED DESCRIPTION OF THE DRAWINGS

Figure 1:
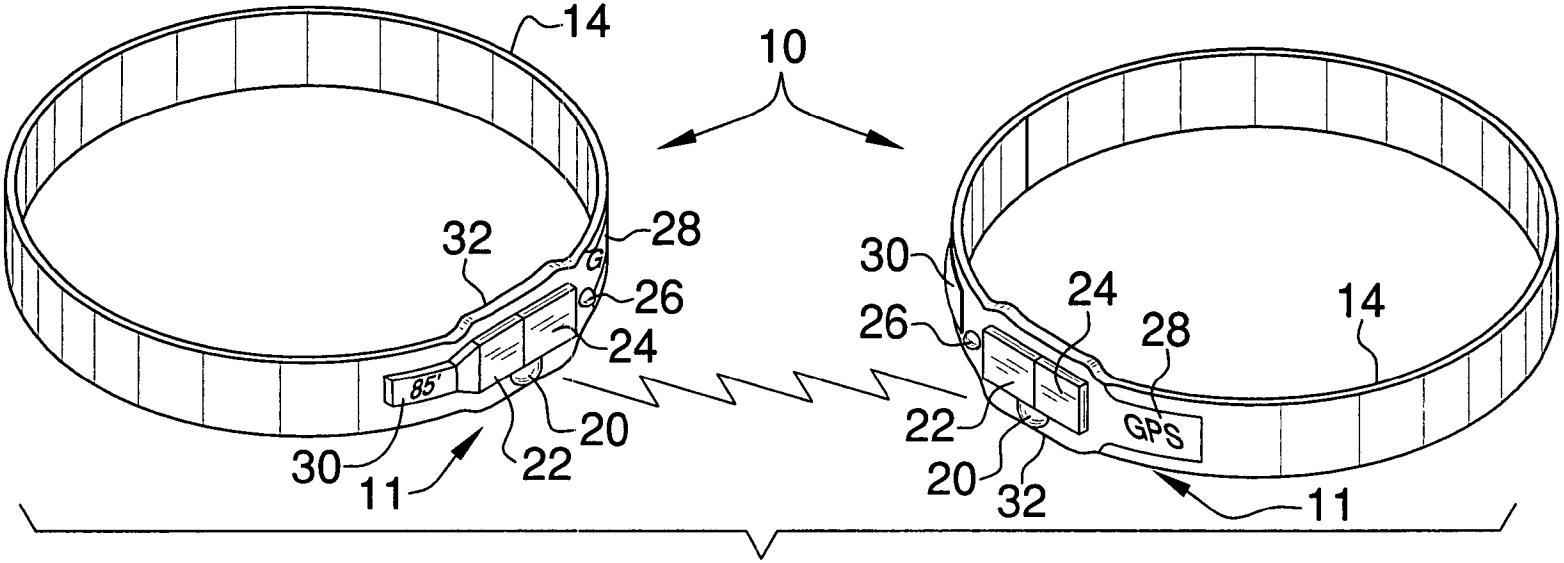
FIG. 1 is a perspective view of the invention, the band example for each person shown.
Figure 2:
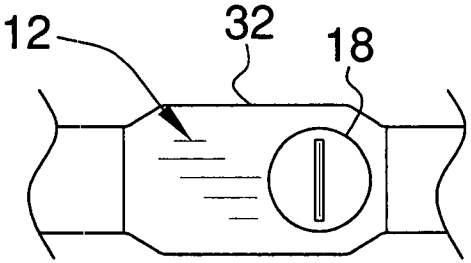
FIG. 2 is a back side plan view of the housing of the invention, the battery access shown therein.
Figure 3:
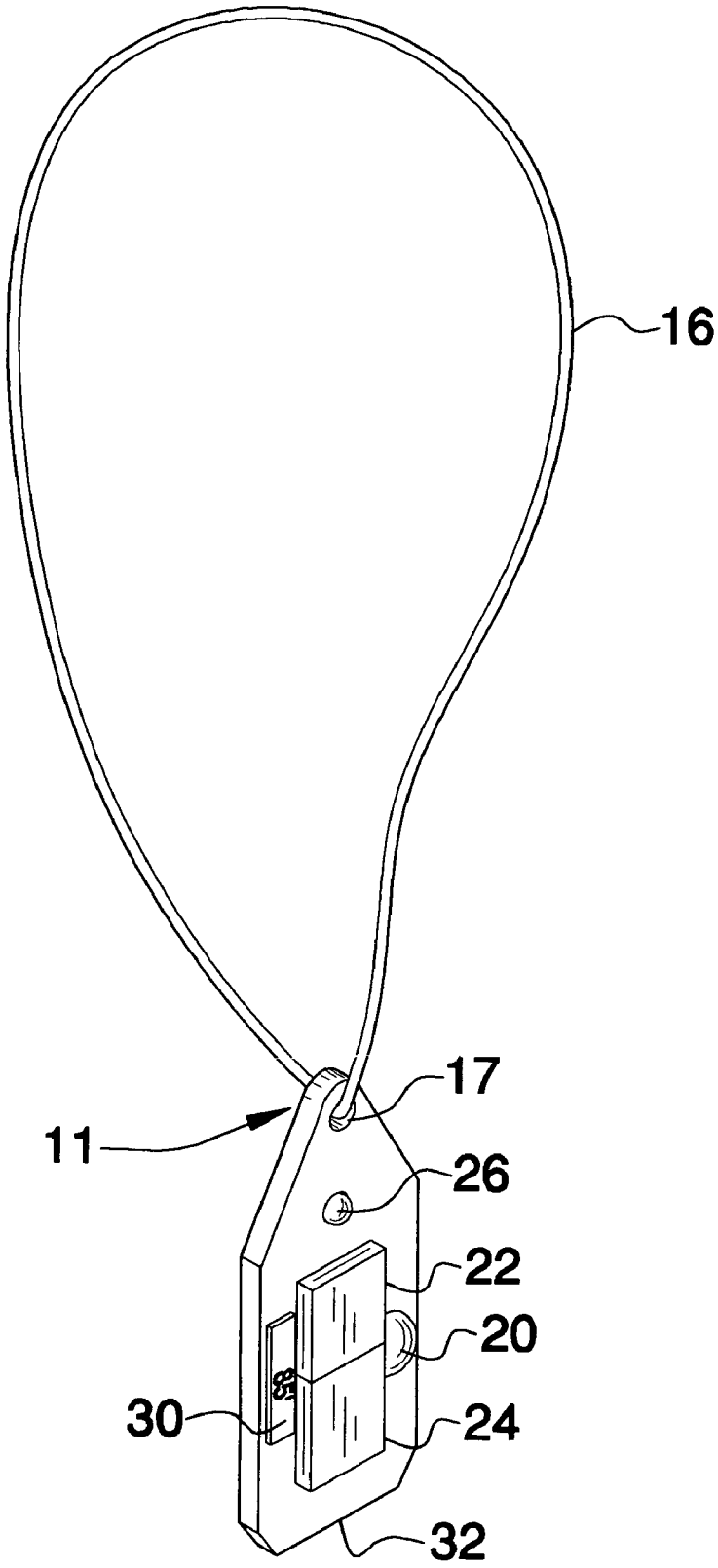
FIG. 3 is a perspective view of the necklace example of the invention.

With reference now to the drawings, and in particular FIGS. 1 through 3 thereof, example of the two-way emergency alert system employing the principles and concepts of the present invention and generally designated by the reference number 10 will be described.

Referring to FIGS. 1 and 2, the invention 10 comprises a pair of separable devices 11 for use by two persons (not shown). Each device 11 is contained within a bracelet band 14. Each device 11 comprises a microprocessor 13 (FIG. 4) assembly and communicating components. The visually accessible components are in communication with the microprocessor 13 within the housing 32. A battery 19 (FIG. 4) power source is contained within the housing 32 for the microprocessor assembly 13 and components. Battery access 18 provides access for the battery 19. Control components tactilely contained within the housing 32 include the GPS instrument 28, the alarm activation button 24, the reset 22, the distance meter 30, and the sequential button 20. The low battery indicator 26 is also visible. The sequential button 20 is sequentially depressed to control, in sequential order, on, audio alarm, vibration alarm, and off. The examples of the invention 10 also feature distance meters 30 with displays, whereby the distance between the two persons is indicated. Distance is indicated in feet separating the two users. Further examples of the invention 10 display distances in meters. Each person wearing the device 11 has the capability of signaling the other device wearer via the alarm activation button 24. Each device 11 wearer sets the controls as desired to either receive audio alarm or vibratory alarm from the other person. Each person is capable of pushing the alarm activation button 24 for sending an alarm signal. Each person manually activates the device 11 to be in readiness for the functions contained in the device. The sequential button 20 activates each device 11 as chosen. The sequential button 20 allows a user to sequentially push the sequential button 20 to first select on. The next push of the sequential button 20 selects audio alarm. The next push of the sequential button 20 selects vibratory alarm. The next push of the sequential button 20 selects off. Each device 11 reset 22 enables a person to reset the functions of the device 11. Electronic technology of the microprocessor 13 and the communicating electronics components provide for a minimum range of 1500 feet in each device 11 communicating with the other device 11. As example of use, if the alarm activation button 24 is pushed by a child, the caregiver is notified by either their own audio alarm or by their own vibratory alarm. The child signaling alarm has the same choice in alarm signals, so that the child knows that the alarm activation button 24 functioned. A caregiver in such a situation would most likely set the child's device 11 to audio, to further assist the caregiver in locating the child. The caregiver views the distance meter 30 to assist in constantly approaching the child until the child is located. In using the example of the invention 10 provided with the GPS instrument 28, the caregiver uses the GPS instrument 28 to locate the child. Upon location of the child, the caregiver uses the resets 22 to turn off both devices 11.

Referring to FIG. 3, the housing 32 is further comprised of an orifice 17 by which the necklace 16 is held. The distance meter 30 is disposed below the reset 22 and the alarm activation button 24.

Figure 4:
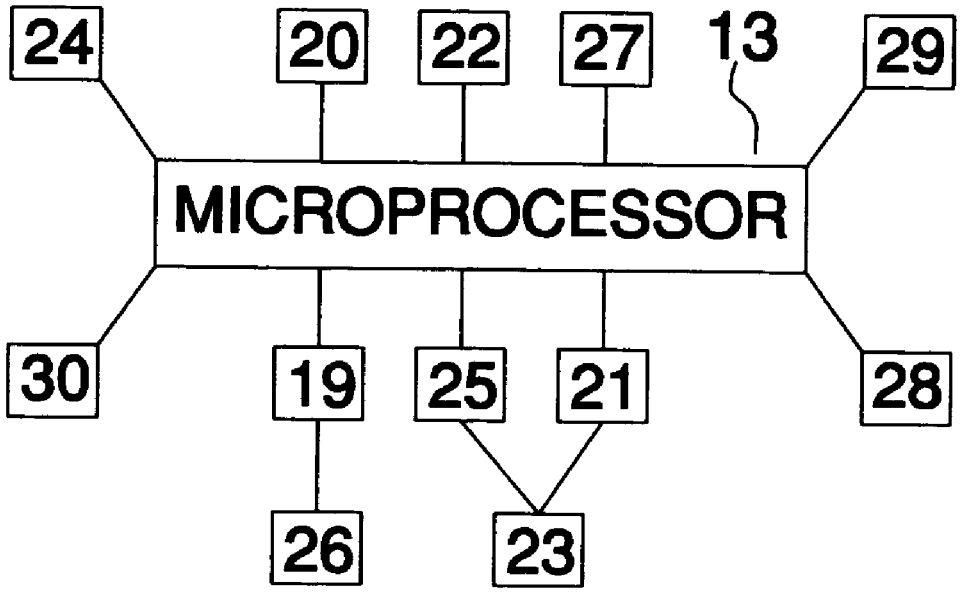
FIG. 4 depicts the electronic communication of the components of the invention.

Referring to FIG. 4, the communication of the electronic components and controls of each device 11 of the invention 10 is illustrated. The microprocessor 13 and related components are contained within housing 32. The low battery indicator 26 communicates directly with the battery 19. The antenna 23 communicates directly with the transmitter 25 and the receiver 21. The transmitter 25 and the receiver 21 communicate with the microprocessor 13. The distance meter 30, the alarm activation button 24, the sequential button 20, the reset 22, the audio output 27, the vibrator 29, and the GPS instrument 28 communicate directly with the microprocessor 13.

With respect to the above description then, it is to be realized that the optimum dimensional relationships for the parts of the two-way emergency alert system, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A two-way emergency alert system, the system comprising a pair of separable devices for use by two persons, each device comprising:

a microprocessor assembly of communicating components, the components comprising:
- a microprocessor;
- a transmitter;
- a receiver;
- an antenna;
- an audio alarm;
- a vibrator;

a housing containing the microprocessor assembly;

powering means within the housing for the microprocessor assembly;

control buttons within the housing, the control buttons communicating with the microprocessor, the control buttons comprising:

a 4-way sequential button, the sequential button sequentially depressed to control:

on;

audio alarm;

vibration alarm;

off;

an alarm activation button;

a reset button;

a low battery indicator light, whereby either person signals an alarm to the other, the alarm received by either vibration alarm or audio alarm.

2. The alert system in claim 1 wherein each device is water resistant.

3. The alert system in claim 2 wherein at least one device is contained within a pendant, the pendant comprising an orifice for accepting a strap.

4. The alert system in claim 3 wherein at least one device is contained within a flexible band, the band worn around the person's neck or wrist.

5. A two-way emergency alert system, the system comprising a pair of separable devices for use by two persons, each device comprising:

a microprocessor assembly of communicating components, the components comprising:

a microprocessor;

a transmitter;

a receiver;

an antenna;

an audio alarm;

a vibrator;

a housing containing the microprocessor assembly;

powering means within the housing for the microprocessor assembly;

control buttons within the housing, the control buttons communicating with the microprocessor, the control buttons comprising:

a 4-way sequential button, the sequential button sequentially depressed to control:

on;

audio alarm;

vibration alarm;

off;

an alarm activation button;

a reset button;

a low battery indicator light;

a distance meter and display, the display indicating the distance between the two persons, whereby either person signals an alarm to the other, the alarm received by either vibration alarm or audio alarm.

6. The alert system in claim 5 wherein each device is water resistant.

7. The alert system in claim 6 wherein at least one device is contained within a pendant, the pendant comprising an orifice for accepting a strap.

8. The alert system in claim 7 wherein at least one device is contained within a flexible band, the band worn around the person's neck or wrist.

9. A two-way emergency alert system, the system comprising a pair of separable devices for use by two persons, each device comprising:

a microprocessor assembly of communicating components, the components comprising:

a microprocessor;

a transmitter;

a receiver;

an antenna;

an audio alarm;

a vibrator;

a housing containing the microprocessor assembly;

powering means within the housing for the microprocessor assembly;

control buttons within the housing, the control buttons communicating with the microprocessor, the control buttons comprising:

a 4-way sequential button, the sequential button sequentially depressed to control:

on;

audio alarm;

vibration alarm;

off;

an alarm activation button;

a reset button;

a low battery indicator light;

a GPS device with display, whereby either person signals an alarm to the other, the alarm received by either vibration alarm or audio alarm.

10. The alert system in claim 9 wherein each device is water resistant.

11. The alert system in claim 10 wherein at least one device is contained within a pendant, the pendant comprising an orifice for accepting a strap.

12. The alert system in claim 11 wherein at least one device is contained within a flexible band, the band worn around the person's neck or wrist.

* * * * *